US012551065B2

(12) United States Patent
Yeung

(10) Patent No.: US 12,551,065 B2
(45) Date of Patent: Feb. 17, 2026

(54) MOBILE FOLDABLE SHOWER MATTRESS

(71) Applicant: Huizhoushi Yihukang Trading Co., Ltd., Huizhou (CN)

(72) Inventor: Kam Tim Yeung, Huizhou (CN)

(73) Assignee: HUIZHOUSHI YIHUKANG TRADING CO., LTD., Huizhou (CN)

( * ) Notice: Subject to any disclaimer, the term of this patent is extended or adjusted under 35 U.S.C. 154(b) by 104 days.

(21) Appl. No.: 18/764,385

(22) Filed: Jul. 5, 2024

(65) Prior Publication Data

US 2025/0009188 A1 Jan. 9, 2025

(30) Foreign Application Priority Data

Jul. 6, 2023 (CN) ..... 202321764120.X

(51) Int. Cl.
*A47K 3/28* (2006.01)

(52) U.S. Cl.
CPC ..... *A47K 3/281* (2013.01)

(58) Field of Classification Search
CPC ..... A47K 3/281; A47K 3/06
USPC ..... 4/611
See application file for complete search history.

(56) References Cited

U.S. PATENT DOCUMENTS 2,950,484 A * 8/1960 Jaffe ..... A47K 3/064 5/98.1
4,577,354 A * 3/1986 Stratton ..... A47K 3/06 4/585
4,785,486 A * 11/1988 Viesturs ..... A47K 3/06 4/593
5,085,212 A * 2/1992 DeCosta ..... E04H 15/003 4/585
10,010,463 B1 * 7/2018 King ..... A47K 3/062

* cited by examiner

*Primary Examiner* — Huyen D Le
(74) *Attorney, Agent, or Firm* — Leong C. Lei

(57) ABSTRACT

A mobile foldable shower mattress includes a main body, an upper waterproof fabric, and a lower waterproof fabric. The main body includes at least two bottom plates, a plurality of side plates, and a plurality of damping hinges. The at least two bottom plates are arranged side by side. The plurality of side plates are located around the at least two bottom plates and hingedly connected to the corresponding bottom plates. An accommodating room is enclosed by the plurality of side plates and the at least two bottom plates. The plurality of damping hinges are each disposed between a corresponding one of the bottom plates and a corresponding one of the side plates.

7 Claims, 6 Drawing Sheets

MOBILE FOLDABLE SHOWER MATTRESS

BACKGROUND OF THE INVENTION

1. Field of the Invention

The present invention relates to a shower mattress, and more particularly to a mobile foldable shower mattress.

2. Description of the Prior Art

There are many foldable shower mattresses on the market. For example, Chinese Utility Model Registration No. ZL201921244264.6 discloses a foldable shower mattress. Although the walls of this shower mattress can be folded, the walls of the shower mattress still have a certain height in the folded state. When a healthcare worker wants to bathe a disabled person, he/she needs to lift the disabled person to the middle of the shower mattress and then spread the walls of the shower mattress, so as to bathe the disabled person. This causes a lot of inconvenience. Besides, the conventional shower mattress is large in size when stored, occupying much space and being unable to meeting the existing needs. Therefore, there is a need to develop a new technical solution to solve the above problems.

SUMMARY OF THE INVENTION

In view of the shortcomings of the prior art, the primary object of the present invention is to provide a mobile foldable shower mattress.

In order to achieve the foregoing object, the present invention adopts the following technical solutions:

A mobile foldable shower mattress comprises a main body, an upper waterproof fabric, and a lower waterproof fabric. The main body includes at least two bottom plates, a plurality of side plates, and a plurality of damping hinges. The at least two bottom plates are arranged side by side. The plurality of side plates are located around the at least two bottom plates and hingedly connected to the corresponding bottom plates. An accommodating room is enclosed by the plurality of side plates and the at least two bottom plates. The plurality of damping hinges are each disposed between a corresponding one of the bottom plates and a corresponding one of the side plates. The upper waterproof fabric is partially attached to an upper surface of the main body. The lower waterproof fabric is partially attached to a lower surface of the main body. The rest of the lower waterproof fabric is overlapped with the rest of the upper waterproof fabric.

Preferably, the bottom plates and the side plates are plastic hollow plates.

Preferably, the bottom plates and the side plates each have a rectangular shape.

Preferably, the number of the bottom plates is two. The two bottom plates are arranged side by side. The number of the side plates is six. The six side plates are located around the two bottom plates and hingedly connected to the corresponding bottom plates. The number of the damping hinges is ten. The ten damping hinges are each disposed between the corresponding bottom plate and the corresponding side plate.

Preferably, the mobile foldable shower mattress further comprises at least two sponges. The at least two sponges are attached to the corresponding bottom plates, respectively. The sponges are each located between the upper waterproof fabric and the corresponding bottom plate.

Preferably, two straps are provided at either end of the lower waterproof fabric for fastening and retaining the side plates after being folded up.

Preferably, the upper waterproof fabric and the lower waterproof fabric are welded by a high-frequency welding machine to form a first welding bar, a second welding bar, a third welding bar and a fourth welding bar. The first welding bar is located between the plurality of side plates and the corresponding bottom plates. The second welding bar is located between the adjacent bottom plates. The third welding bar is located between the adjacent side plates. The fourth welding bar is located at peripheral edges of the upper waterproof fabric and the lower waterproof fabric.

Compared with the prior art, the present invention has obvious advantages and beneficial effects. Specifically, it can be known from the above technical solutions:

In the present invention, the main body includes at least two bottom plates, a plurality of side plates, and a plurality of damping hinges. The at least two bottom plates are arranged side by side. The plurality of side plates are located around the at least two bottom plates and hingedly connected to the corresponding bottom plates. An accommodating room is enclosed by the plurality of side plates and the at least two bottom plates. The plurality of damping hinges are each disposed between a corresponding one of the bottom plates and a corresponding one of the side plates. An upper waterproof fabric is partially attached to an upper surface of the main body. A lower waterproof fabric is partially attached to a lower surface of the main body. The rest of the lower waterproof fabric is overlapped with the rest of the upper waterproof fabric. This shower mattress is used for bathing a patient on the bed, without lifting the patient. It is beneficial for healthcare workers to bathe patients. The operation is more convenient. The shower mattress has a folding function. Through reasonable design, the volume of the folded shower mattress can be reduced greatly, occupying less space. It is able to be easily carried or moved, meeting the existing needs.

DETAILED DESCRIPTION OF THE PREFERRED EMBODIMENTS

Figure 1:
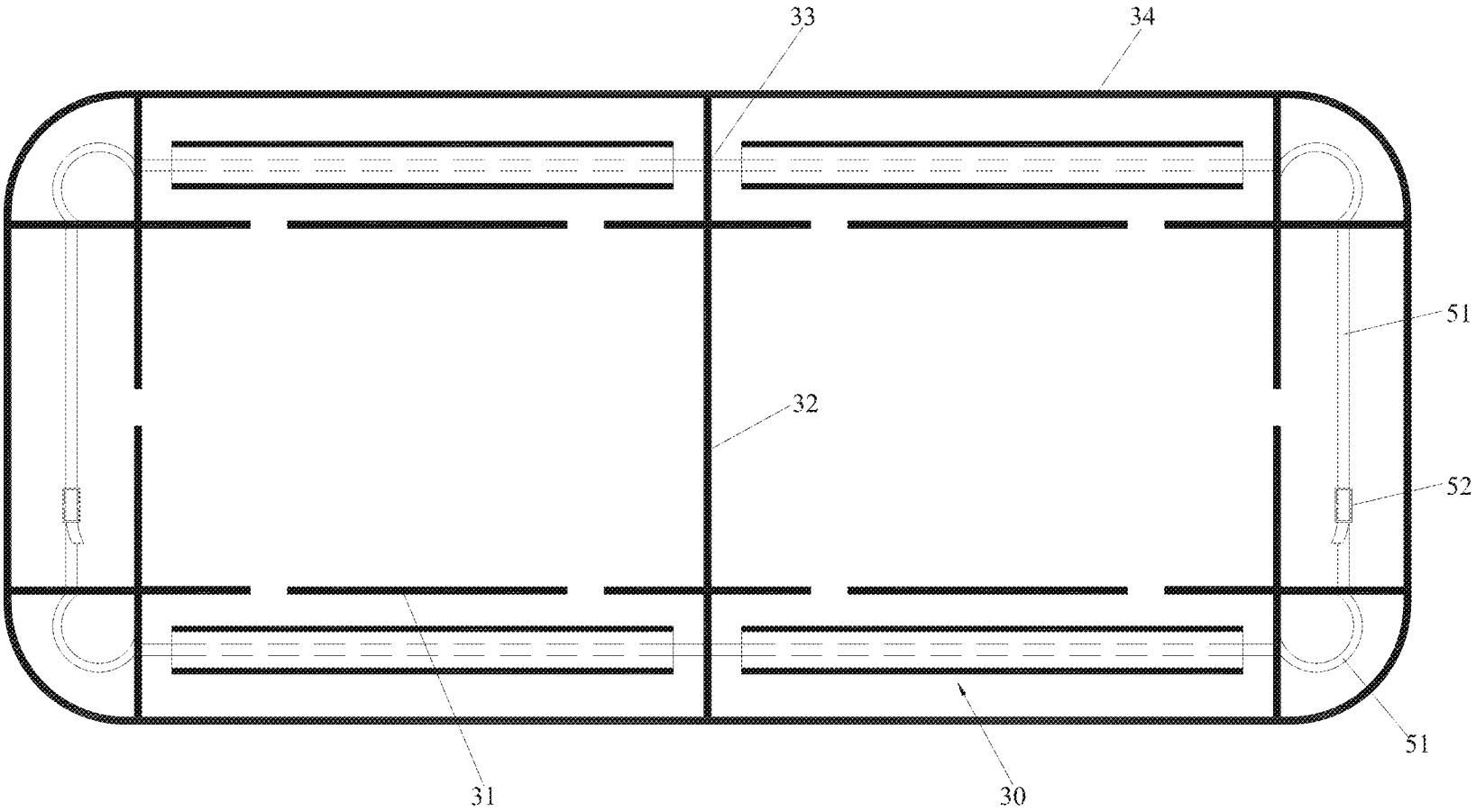
FIG. 1 is a back view in accordance with a preferred embodiment of the present invention.
Figure 2:
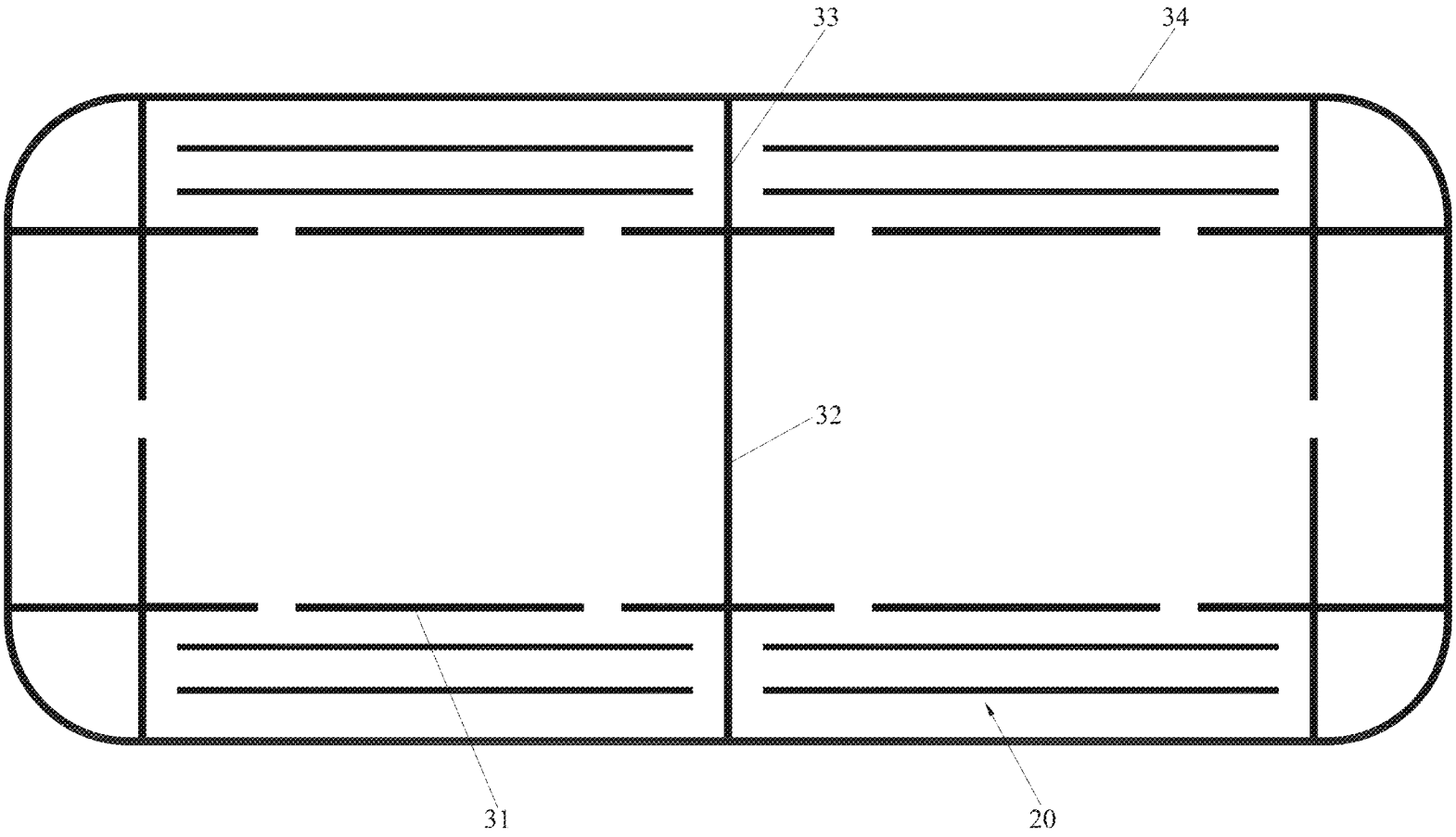
FIG. 2 is a front view in accordance with the preferred embodiment of the present invention.
Figure 3:
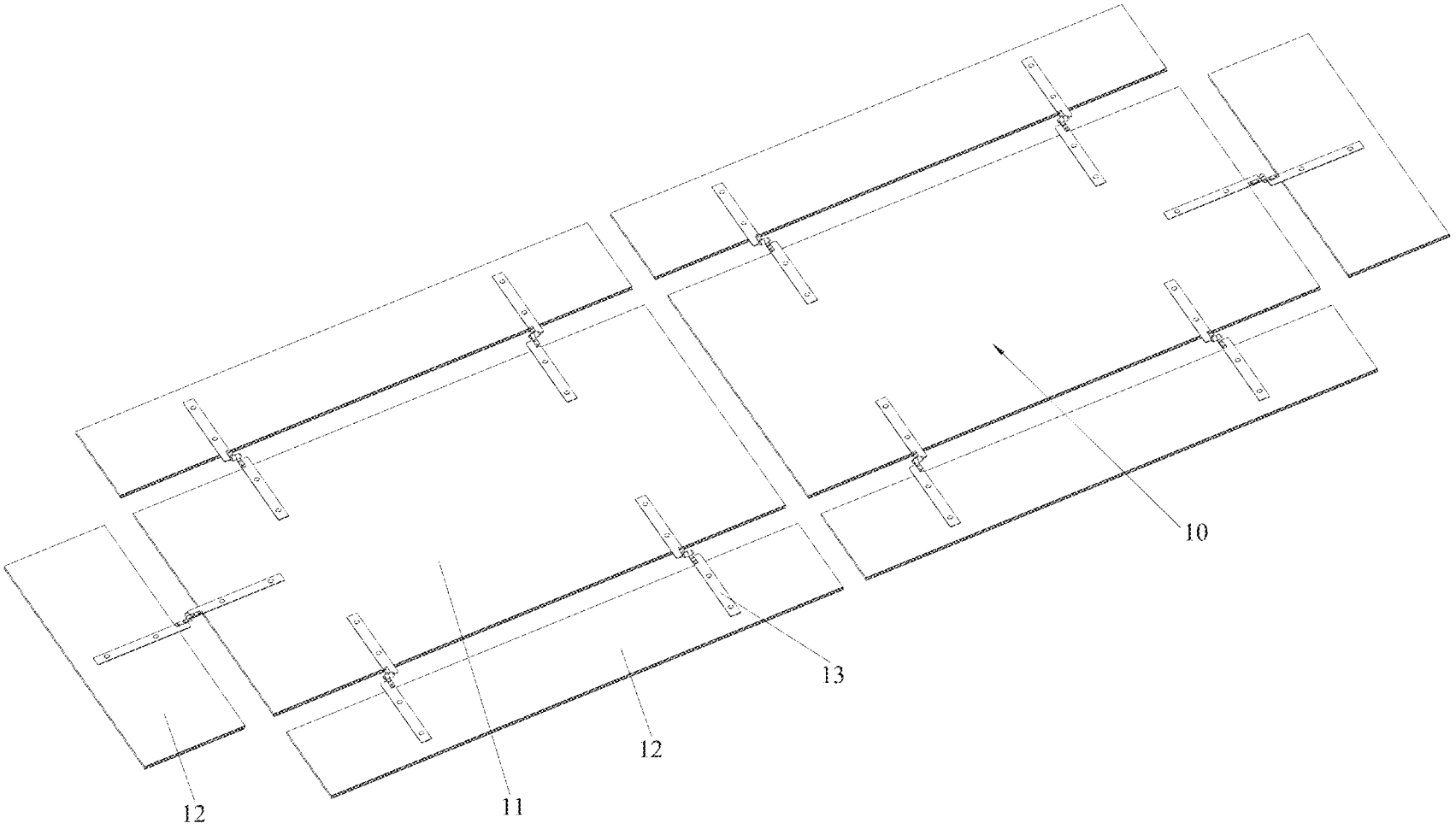
FIG. 3 is a perspective view of the main body in accordance with the preferred embodiment of the present invention.
Figure 4:
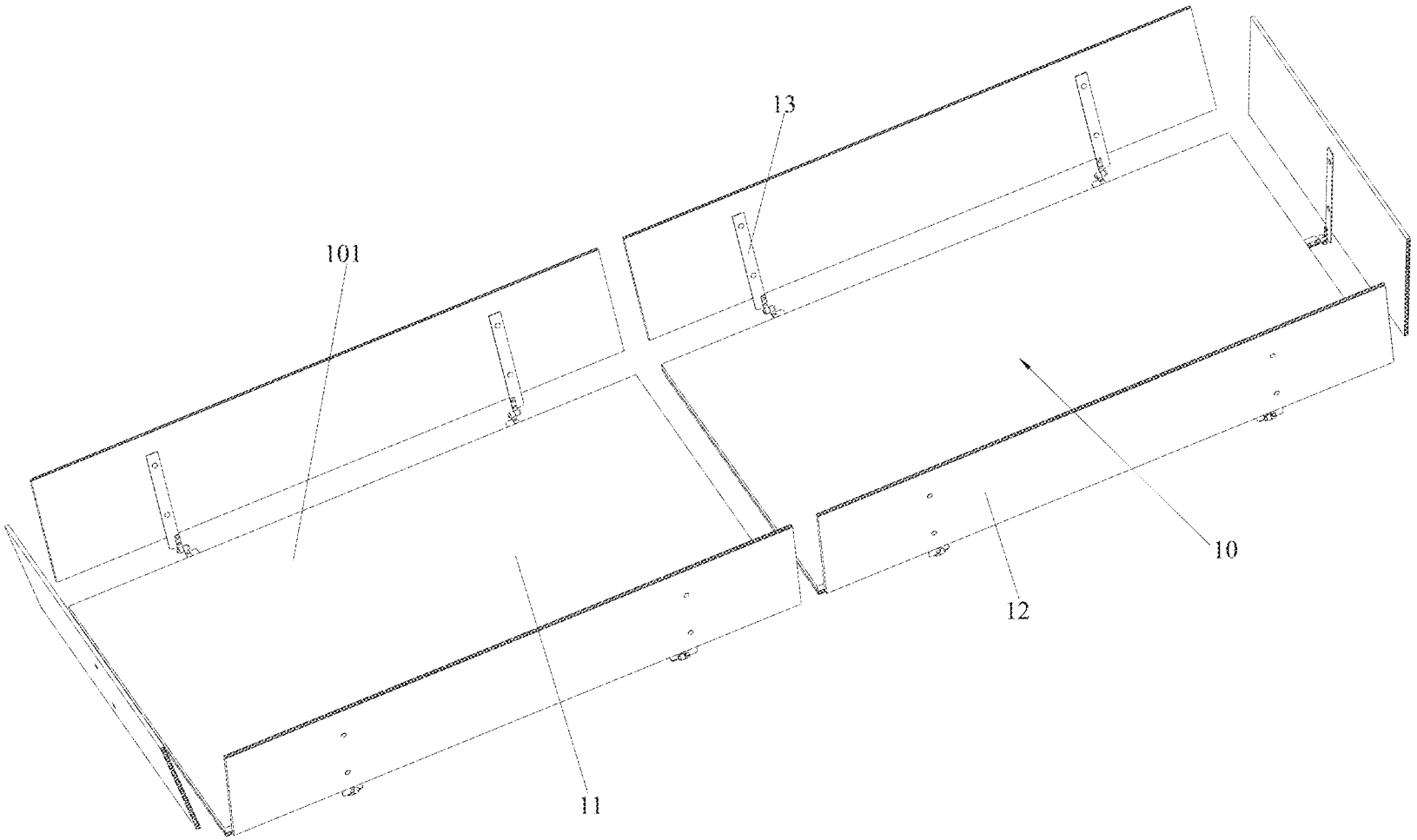
FIG. 4 is a perspective view of the main body when in use in accordance with the preferred embodiment of the present invention.
Figure 5:
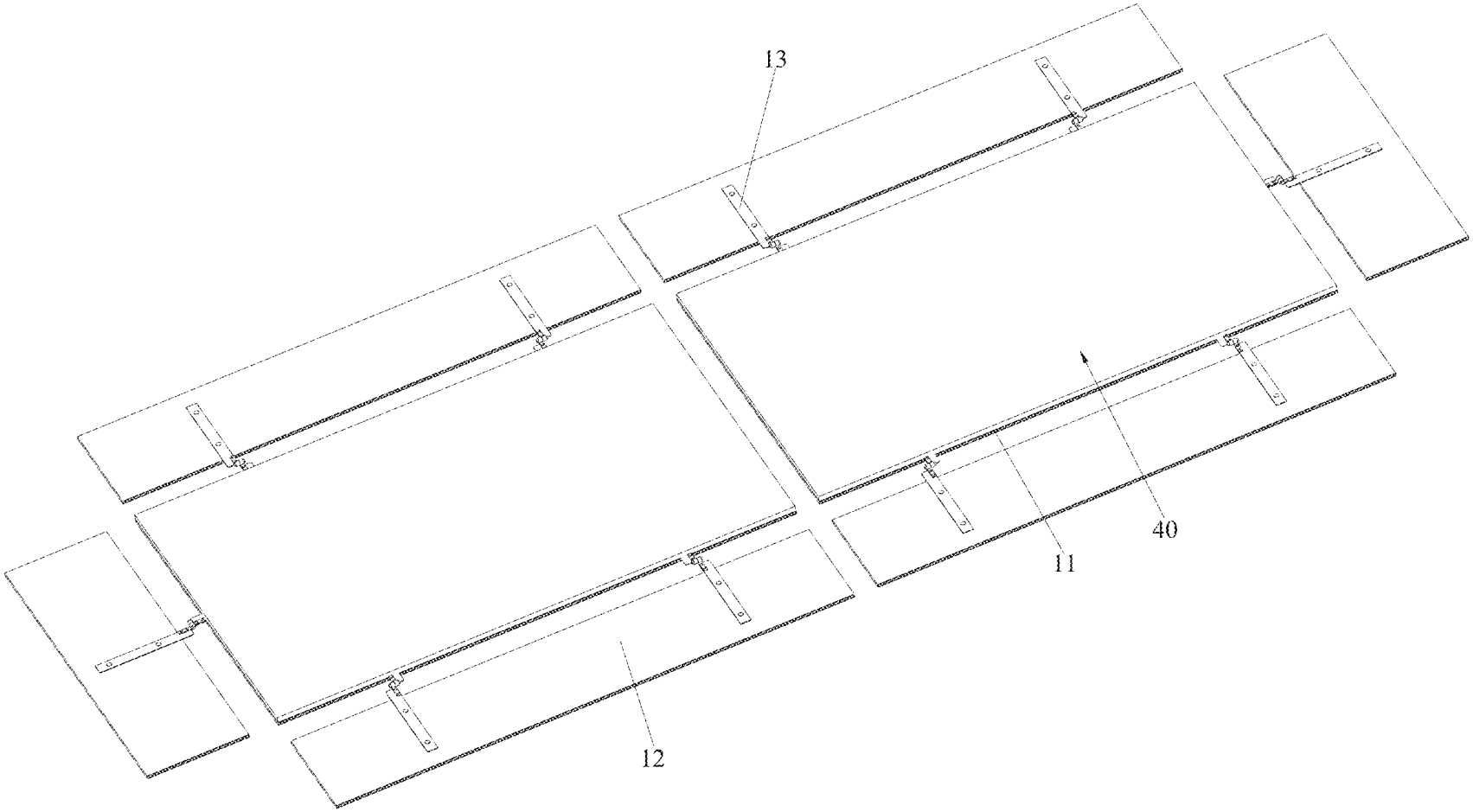
FIG. 5 is a perspective view of the main body and the sponges in accordance with the preferred embodiment of the present invention.
Figure 6:
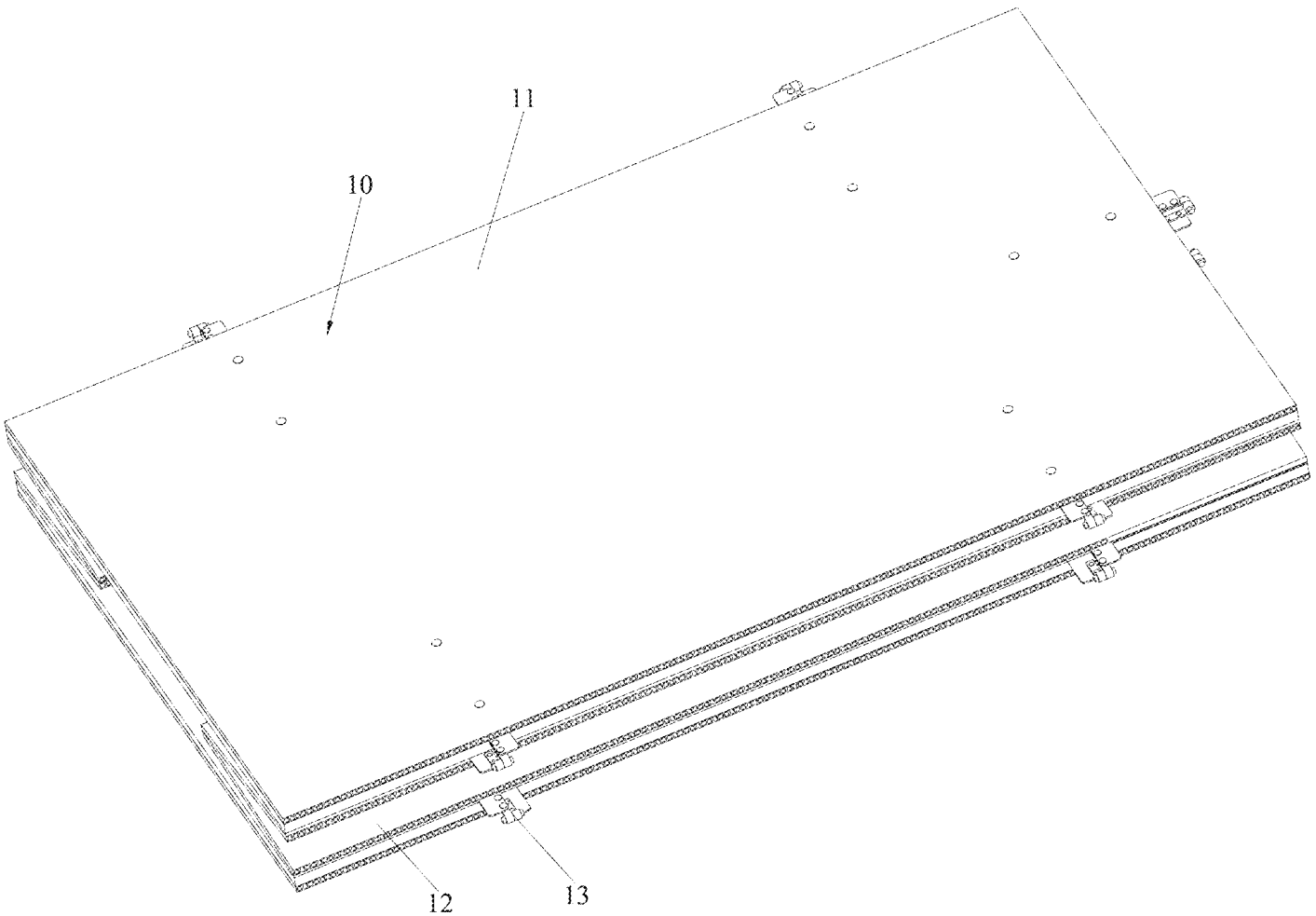
FIG. 6 is a perspective view of the main body in a folded state in accordance with the preferred embodiment of the present invention.

FIG. 1 to FIG. 6 illustrate the specific structure of a preferred embodiment of the present invention, comprising a main body 10, an upper waterproof fabric 20 and a lower waterproof fabric 30.

The main body 10 includes at least two bottom plates 11, a plurality of side plates 12, and a plurality of damping hinges 13. The at least two bottom plates 11 are arranged side by side. The plurality of side plates 12 are located around the at least two bottom plates 11 and hingedly connected to the corresponding bottom plates 11. The plurality of side plates 12 may be folded 0-180 degrees relative to the corresponding bottom plates 11. An accommodating room 101 is enclosed by the plurality of side plates 12 and the at least two bottom plates 11. The accommodating room 101 is configured to store water for bathing a patient. The plurality of damping hinges 13 are each disposed between the corresponding bottom plate 11 and the corresponding side plate 12. In this embodiment, the bottom plates 11 and the side plates 12 are plastic hollow plates. The bottom plates 11 and the side plates 12 each have a rectangular shape. The number of the bottom plates 11 is two. The two bottom plates 11 are arranged side by side. The number of the side plates 12 is six. The six side plates 12 are located around the two bottom plates 11 and hingedly connected to the corresponding bottom plates 11. The number of the damping hinges 13 is ten. The ten damping hinges 13 are each disposed between the corresponding bottom plate 11 and the corresponding side plate 12.

The upper waterproof fabric 20 is partially attached to the upper surface of the main body 10. The lower waterproof fabric 30 is partially attached to the lower surface of the main body 10. The rest of the lower waterproof fabric 30 is overlapped with the rest of the upper waterproof fabric 20. The upper waterproof fabric 20 and the lower waterproof fabric 30 have good waterproof performance. In this embodiment, two straps 51 are provided at either end of the lower waterproof fabric 30 for fastening and retaining the side plates 12 after being folded up. Specifically, the two straps 51 are secured by a buckle 52. The upper waterproof fabric 20 and the lower waterproof fabric 30 are welded by a high-frequency welding machine to form a first welding bar 31, a second welding bar 32, a third welding bar 33 and a fourth welding bar 34. The first welding bar 31 is located between the plurality of side plates 12 and the corresponding bottom plates 11. The second welding bar 32 is located between the adjacent bottom plates 11. The third welding bar 33 is located between the adjacent side plates 12. The fourth welding bar 34 is located at the peripheral edges of the upper waterproof fabric 20 and the lower waterproof fabric 30. Using the high-frequency welding machine to perform a welding process is easy for operation, and the connection is reliable and stable.

Furthermore, the present invention further comprises at least two sponges 40. The at least two sponges 40 are attached to the corresponding bottom plates 11, respectively. The sponges 40 are each located between the upper waterproof fabric 20 and the corresponding bottom plate 11. In this embodiment, the number of the sponges 40 is two. The two sponges 40 each have a rectangular shape matching the corresponding bottom plate 11. The two sponges 40 are attached to the corresponding bottom plates 11 for increasing the comfort of the product.

The manufacturing process and usage of this embodiment are described in detail as follows:

In the process of production, two bottom plates 11 and six side plates 12 are first formed. Ten damping hinges 13, four straps 51 and two buckles 52 are prepared. An upper waterproof fabric 20, a lower waterproof fabric 30 and two sponges 40 are cut. Next, the ten damping hinges 13 are each mounted between the corresponding bottom plate 11 and the corresponding side plate 12 to form the main body 10, and the six side plates 12 can be folded 0-180 degrees relative to the corresponding bottom plates 11, thereby forming an accommodating room 101. Then, the two straps 51 are welded to one end of the lower waterproof fabric 30 using a high frequency machine. The two straps 51 are arranged symmetrically on the left and right. The other two straps 51 are welded to the other end of the lower waterproof fabric 30 using the high-frequency welding machine. The other two straps 51 are also arranged symmetrically on the left and right. The two buckles 52 are mounted to the corresponding straps 51, respectively. Next, the two sponges 40 are placed on the corresponding bottom plates 11. Then, the lower waterproof fabric 30 is attached to the lower surface of the main body 10. The upper waterproof fabric 20 is attached to the upper surfaces of the six side plates 12 and the two sponges 40. Finally, the upper waterproof fabric 20 and the lower waterproof fabric 30 are welded using the high-frequency welding machine to form the first welding bar 31, the second welding bar 32, the third welding bar 33 and the fourth welding bar 34.

When in use, the six side plates 12 are folded up at a desired angle relative to the corresponding bottom plates 11 to form the accommodating room 101. Then, the two straps 51 at one end of the lower waterproof fabric 30 are tightened through the buckle 52, and the other two straps 51 at the other end of the lower waterproof fabric 30 are tightened through the other buckle 52 to form a bathtub. Then, water is injected in the accommodating room 101 for bathing the patient on the bed, without lifting the patient. It is simple in operation and easy to use the shower mattress. After use, the water is pumped out, and the straps 51 are loosened. The six side plates 12 are folded relative to the corresponding bottom plates 11, and then the two bottom plates 11 are folded in half, which facilitates storage and saves space.

What is claimed is:

1. A mobile foldable shower mattress, comprising a main body, an upper waterproof fabric and a lower waterproof fabric; the main body including at least two bottom plates, a plurality of side plates and a plurality of damping hinges, the at least two bottom plates being arranged side by side, the plurality of side plates being located around the at least two bottom plates and hingedly connected to the corresponding bottom plates, an accommodating room being enclosed by the plurality of side plates and the at least two bottom plates, the plurality of damping hinges being each disposed between a corresponding one of the bottom plates and a corresponding one of the side plates; the upper waterproof fabric being partially attached to an upper surface of the main body, the lower waterproof fabric being partially attached to a lower surface of the main body, the rest of the lower waterproof fabric being overlapped with the rest of the upper waterproof fabric.

2. The mobile foldable shower mattress as claimed in claim 1, wherein the bottom plates and the side plates are plastic hollow plates.

3. The mobile foldable shower mattress as claimed in claim 1, wherein the bottom plates and the side plates each have a rectangular shape.

4. The mobile foldable shower mattress as claimed in claim 1, wherein the number of the bottom plates is two, the two bottom plates are arranged side by side; the number of the side plates is six, the six side plates are located around the two bottom plates and hingedly connected to the corresponding bottom plates; the number of the damping hinges is ten, and the ten damping hinges are each disposed between the corresponding bottom plate and the corresponding side plate.

5. The mobile foldable shower mattress as claimed in claim 1, further comprising at least two sponges, the at least two sponges being attached to the corresponding bottom plates respectively, the sponges being each located between the upper waterproof fabric and the corresponding bottom plate.

6. The mobile foldable shower mattress as claimed in claim 1, wherein two straps are provided at either end of the lower waterproof fabric for fastening and retaining the side plates after being folded up.

7. The mobile foldable shower mattress as claimed in claim 1, wherein the upper waterproof fabric and the lower waterproof fabric are welded by a high-frequency welding machine to form a first welding bar, a second welding bar, a third welding bar and a fourth welding bar, the first welding bar is located between the plurality of side plates and the corresponding bottom plates, the second welding bar is located between the adjacent bottom plates, the third welding bar is located between the adjacent side plates, and the fourth welding bar is located at peripheral edges of the upper waterproof fabric and the lower waterproof fabric.

* * * * *